United States Patent [19]

Pappas

[11] 4,006,471

[45] Feb. 1, 1977

[54] EMERGENCY EXIT LOCK SYSTEM FOR DOORS

[75] Inventor: Michael Pappas, Irvington, N.J.

[73] Assignee: Detex Corporation, New York, N.Y.

[22] Filed: Jan. 31, 1975

[21] Appl. No.: 545,922

[52] U.S. Cl. ..... 340/274 R; 70/92; 70/432; 292/92

[51] Int. Cl.[2] ..... G08B 13/08

[58] Field of Search ..... 340/274 R; 70/92, 432, 70/1; 292/92

[56] References Cited

UNITED STATES PATENTS

| | | | |
|---|---|---|---|
| 785,228 | 3/1905 | Phelps | 70/432 |
| 2,170,521 | 8/1939 | Rodth | 340/274 |
| 2,287,572 | 6/1942 | Rodth | 340/274 |
| 3,435,643 | 4/1969 | Pollak et al. | 70/92 |
| 3,444,546 | 5/1969 | Hawkins | 340/274 |

*Primary Examiner*—Glen R. Swann, III
*Attorney, Agent, or Firm*—Eisenman, Allsopp & Strack

[57] ABSTRACT

A lock system controls exiting and entering of personnel, particularly in public and commercial structures by means of an alarm and a panic bar and key system to operate a lock through a series of interlocking controls including an internal panic bar, an internal key lock, an external key lock and a supplemental manual control. Four modes of operation are provided in which the panic bar is at all times operative and the alarm is selectively operative to provide, in addition to panic bar actuation or in combination therewith, authorized passage, authorized exit only, free passage in both directions and free exit only.

11 Claims, 16 Drawing Figures

FIG.8
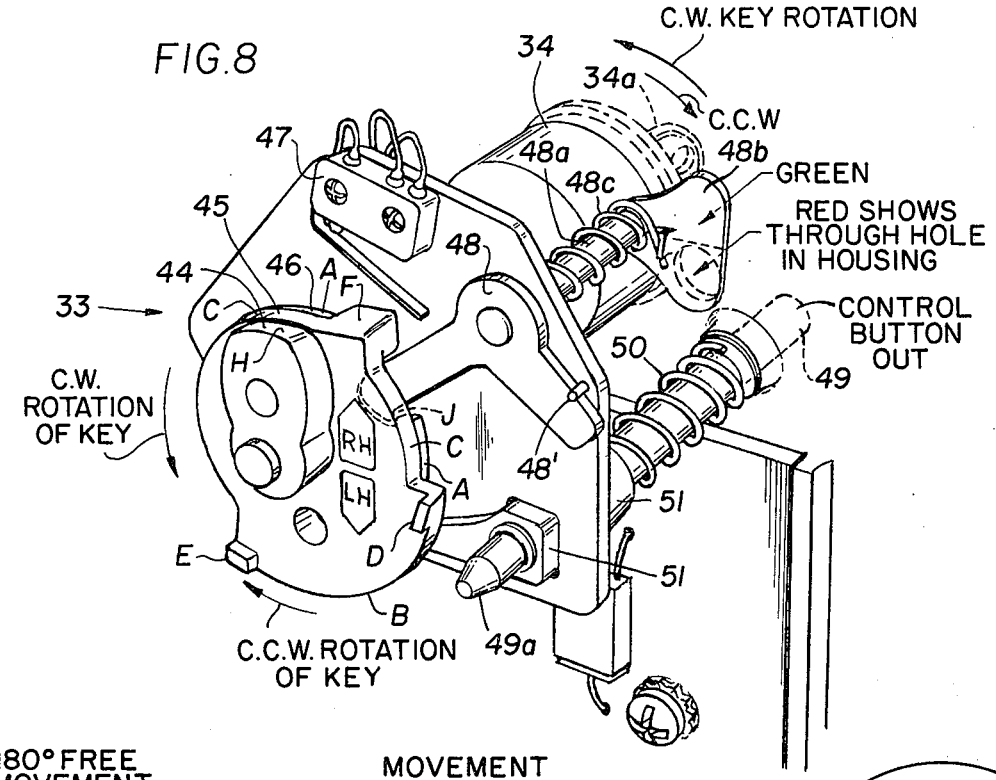
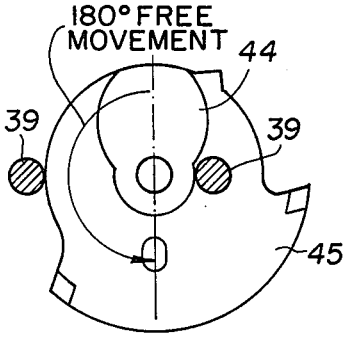
NORMAL POSITION
FIG.9A
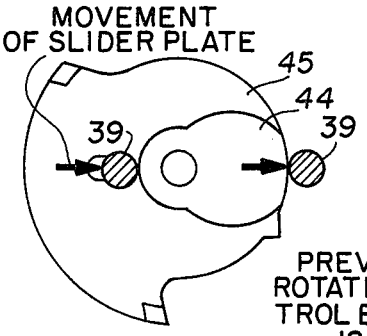
OPERATION FOR FREE PASSAGE
FIG.9B
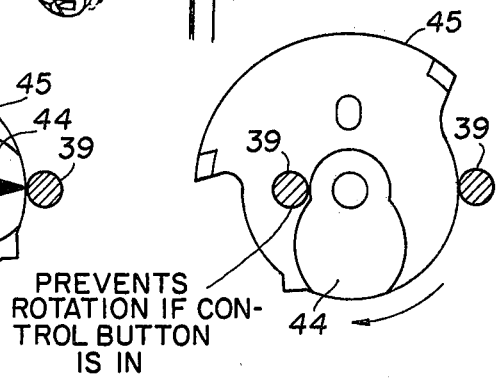
FAIL SAFE FEATURE
FIG.9C
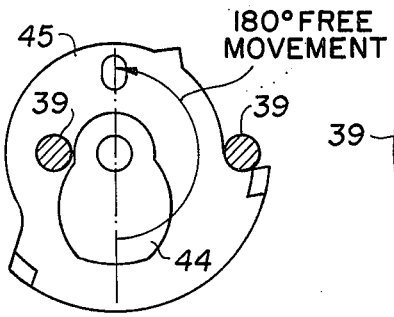
NORMAL POSITION
FIG.10A
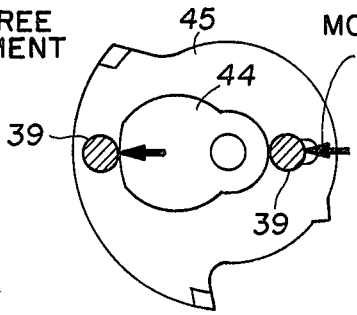
OPERATION FOR FREE PASSAGE
FIG.10B
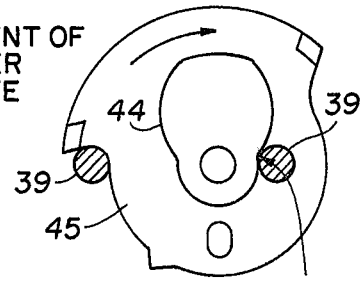
FAIL SAFE FEATURE
FIG.10C

EMERGENCY EXIT LOCK SYSTEM FOR DOORS

BACKGROUND OF THE INVENTION

For the safety of personnel in various public and commercial structures a relatively large number of strategically placed exits are required which afford the opportunity for quick exit without keys. In most cases it is impractical to provide a security guard at each such exit and accordingly, special locking and release hardware has been evolved. Such mechanism often includes an alarm which will sound either locally or remotely, or both, to indicate that the door has been opened by unauthorized personnel. It is generally required that such hardware provide that a locked door will automatically become unlocked when pressed in the correct location, this normally being done through the agency of a panic bar coupled to the latchbolt. Because a panic bar can also be used surreptitiously in situations not involving emergencies, it is required that an alarm sound under most conditions under which the door is opened by the panic bar. On the other hand, it is required in order to prevent indiscriminate sounding of the alarm in situations not involving emergencies or unauthorized, surreptitious use that authorized personnel exit or enter or both without sounding the alarm. The selection of modes of operation to suit such variety of requirements cannot normally be accomplished without introducing complexity to the mechanism which typically affects its reliability or without making it so difficult to change the modes of operation that it cannot be achieved other than by a highly trained mechanic.

The present invention has for its principal objects therefore to provide a highly reliable, rugged but nevertheless simplified device which can effect exit and entry control of the door to provide a variety of operating modes which can be readily selected without dismantling the unit and without the requirement for special tools other than coded keys.

It is a further object of the invention to provide an exit and entry control lock with audible or other alarm mechanism associated therewith which can be set to operate in as many as four modes both including and excluding the alarm.

In accordance with the invention, there is provided within an armored housing a basic latchbolt mechanism which is dead latched at all times against picking or forcing and in which the dead latch means is at all times coupled to a primary exit release mechanism, such as a panic bar, and which further includes controls to actuate an audible or other alarm device which can be incorporated in the same armored housing. Key operated locks can be provided both from the outside and inside of the door coupled into the latchbolt mechanism so that it can if desired be released without sounding the alarm. A mode selection control is included under which key actuation can be selectively used to disarm the alarm and provide entry. Interacting cam mechanism within the unit can be set so that a key can be used by authorized personnel for entering and exiting with an alarm sounding if a key is not used when leaving. A further actuation of the cam mechanism prevents entry even though a key might be introduced into the outside key cylinder. Also, a key used internally can disarm the alarm for a period of time sufficient for one person to leave. Free passage can be provided for permitting entering and leaving without the use of a key.

BRIEF DESCRIPTION OF THE DRAWINGS

FIG. 8 is a view in perspective of a portion of the mechanism of FIG. 7 with the control set in a different mode of operation;

FIGS. 9A, 9B and 9C show the cam control mechanism respectively in normal position, operation for free passage and fail safe in a "left hand" installation; and FIGS. 10A, 10B and 10C are figures corresponding to FIGS. 9A, 9B and 9C but showing cam and slide plate positions which occur when the lock is on the opposite side of the door in a "right hand" installation.

Figure 2:
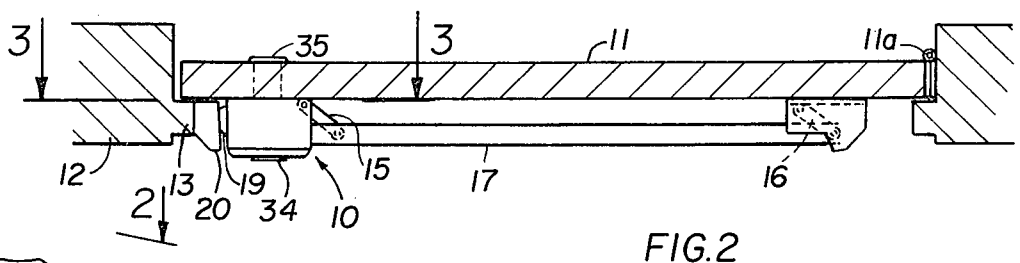
FIG. 2 is a view in transverse section through the door and latch and alarm mechanism of FIG. 1 taken on the line 2—2 of FIG. 1 looking in the direction of the arrows.
Figure 1:
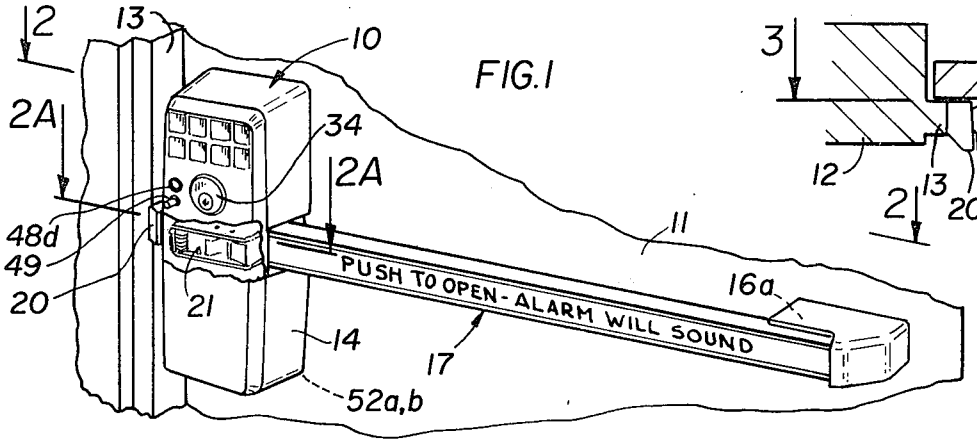
FIG. 1 is a view in front elevation of a "left hand" installation on a door as seen from the inside and to which latching and alarm hardware in accordance with the present invention are affixed.

Referring first to FIGS. 1 and 2, the invention is illustrated as embodied in an exit and entry control lock system indicated generally by the numeral 10 attached to a door 11 hinged at its right hand edge **11*a* in a door jamb 12 including a door stop 13**, the door being adapted to open outwardly from the building as required for commercial and public structures.

The exit and entry control lock system 10 includes an armored housing 14 from which projects a pivot arm 15, which is parallel to a second pivot arm 16 mounted near the hinge edge of the door within a cover **16*a*. Joining the free ends of the two pivot arms 15 and 16 in a pivotal connection therewith is a panic bar 17 carrying suitable legends as to function and purpose. The panic bar and its mounting assembly is spring biased outwardly by means of a coil spring 18 within the armored housing 14 and connected to a secondary pivot arm 15*a* formed integrally with the panic bar pivot arm 15. When the panic bar 17 is pressed inwardly toward the door, either by hand as in the case of non-emergency exiting or by the pressure of personnel squeezed against the door under extreme emergency conditions, the pivot arm 15 will swing inwardly to release a swinging latchbolt 19 which is received within its keeper 20 attached to the door stop 13. The latchbolt 19 is part of a latchbolt subassembly 21 contained within a housing 21*a* mounted on a back plate 22 secured to the door 11**

Figure 4A:
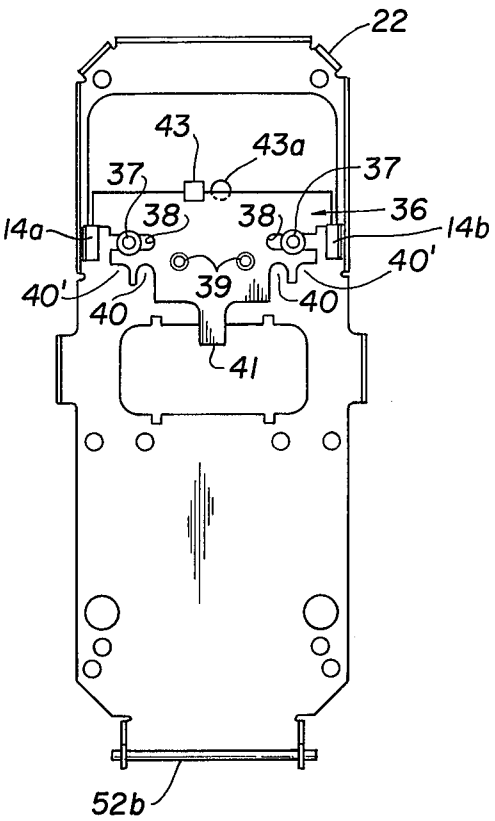
FIG. 4A is a view in front elevation showing the internal frame of the main control unit showing the front portion of the housing removed.
Figure 4B:
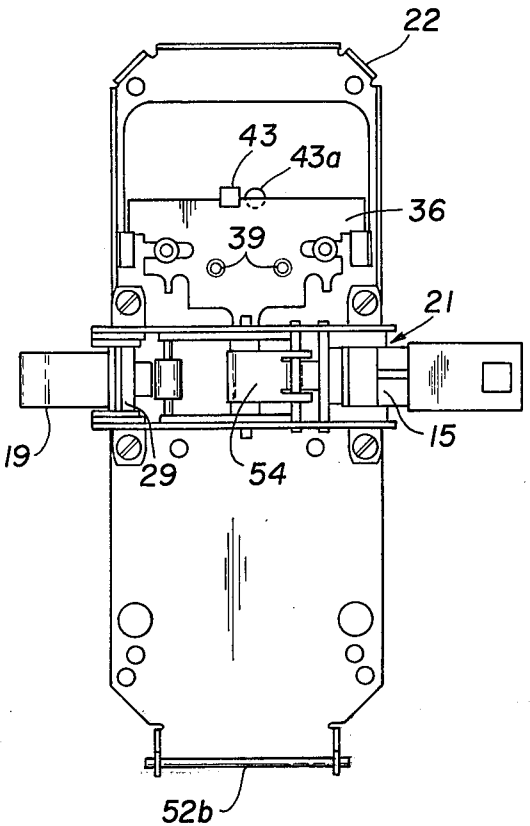
FIG. 4B is a view corresponding to FIG. 4A but showing the latchbolt mechanism attached.

(also seen in FIGS. 4A and 4B). Certain structural details and functions of this subassembly are disclosed and claimed in the co-pending application, Ser. No. 541,080, filed Jan. 15, 1975, now U.S. Pat. No. 3,970,339, issued July 20, 1976, and having a common assignee with the present application.

For purposes of the present disclosure, the latchbolt subassembly is broadly described as including double swinging mounting 23 for the latchbolt 19 controlled by a dead latch pivot arm 24, one end of which carries a roller 25 engaging a tail piece 19*a* on the latchbolt 19. The dead latch arm 24 is pivoted to the frame at 26 and is normally spring biased in a counterclockwise direction as viewed in FIG. 2A against a stop 27. The panic bar pivot arm 15 carries an extension 15*b* adapted to engage the remote end of the dead latch pivot arm 24 so that when the panic bar is pressed the dead latch will swing in a clockwise direction to free the latchbolt 19.

The forward edge 19*b* of the latchbolt 19 is contoured to form a camming surface which normally engages the forward barrier wall 20*a* of the keeper 20. When the door is pushed outward, the interaction of the camming surface 19*b* and the barrier 20*a* will cause the latchbolt 19 to swing in a counterclockwise direction about a first pivot 28 to release the door. When the door closes, the latchbolt will be caused to swing in a clockwise direction about a second pivot 29 by the camming action of the contoured trailing edge 19*c* of the latchbolt against the forward edge of barrier 20*a* of the keeper, after which re-latching occurs (the latchbolt being spring biased outward about both of its pivot axes). The first pivot 28 is carried by brackets 28*a* which swing on the pivot 29 to accommodate swinging movement of the latchbolt when the door closes.

Figure 3:
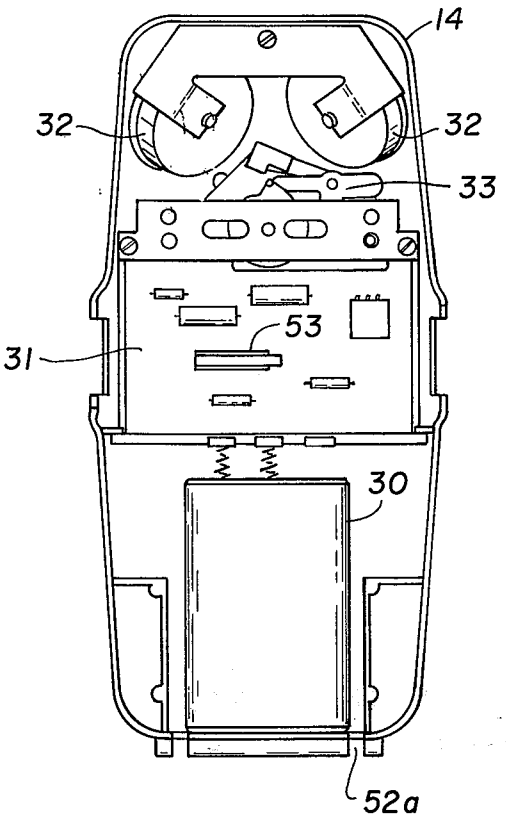
FIG. 3 is a view in back elevation of the control unit taken on the line 3—3 of FIG. 2 looking in the direction of the arrows and with the latchbolt mechanism removed and also with the cover plate removed.

As best seen in FIG. 3, there is mounted within the armored housing 14 an alarm power source in the form of a battery 30 connected through switch and control circuitry, indicated generally by the numeral 31, to a pair of alarms or horns 32 in the upper corners of the housing which is perforated to vent the acoustic energy. Disposed below the horns 32 is a lock and mode control mechanism, indicated generally by the numeral 33. Coupled to that mechanism from the front of the armored housing 14 (FIG. 1) is an inner key-operated lock cylinder 34. An outer key cylinder 35 (FIGS. 2 and 6) is also coupled to the lock and mode control mechanism 33, this lock cylinder being normally housed within a bore in the door 11. The interaction of the inner and outer lock cylinders 34 and 35 and the mechanism 33 will be more fully described below having reference to FIGS. 6, 7 and 8.

Figure 2A:
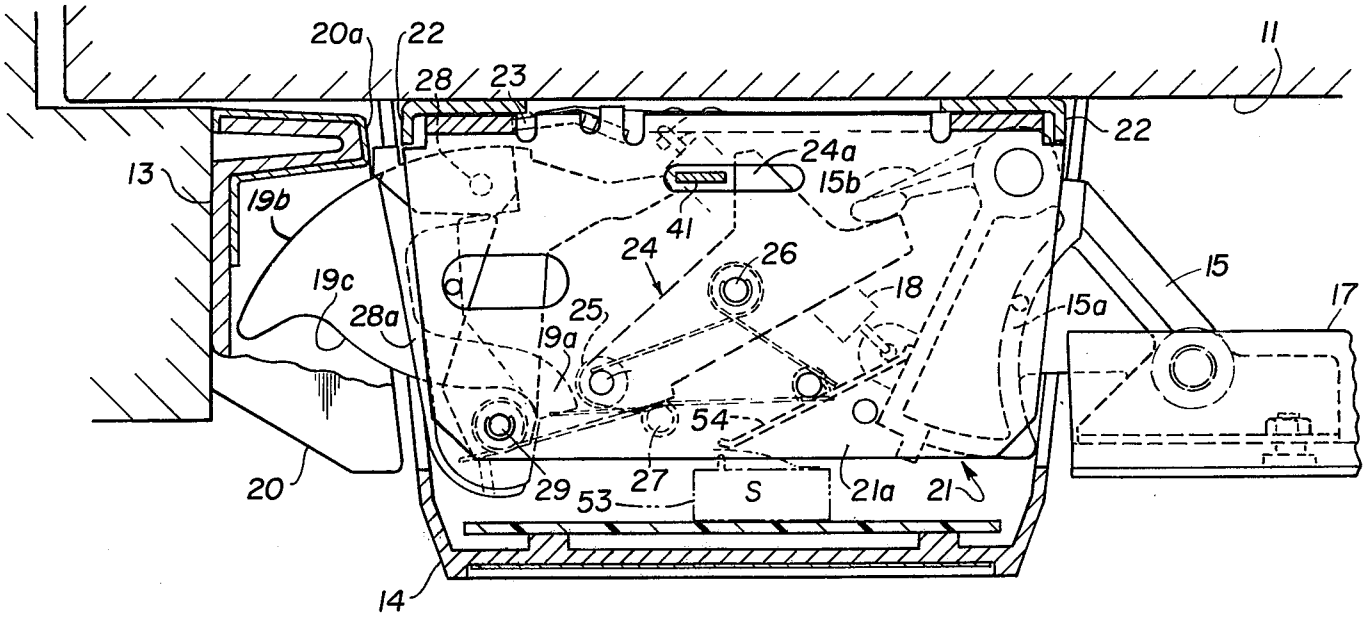
FIG. 2A is an enlarged view in horizontal section taken on the line 2A—2A of FIG. 1.
Figure 6:
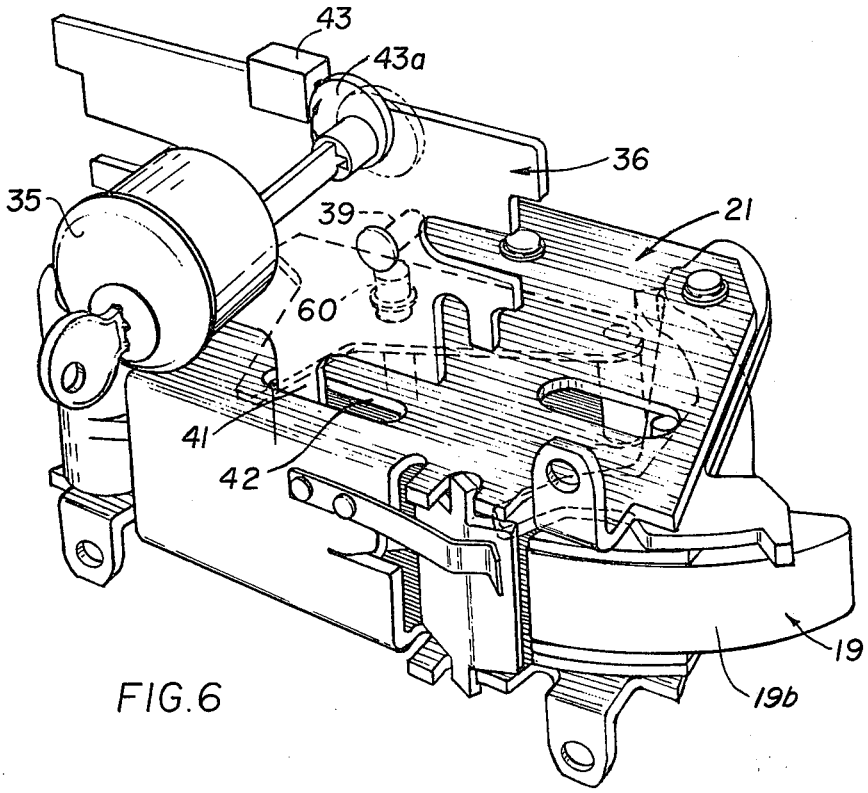
FIG. 6 is a fragmentary view in perspective of the outside cylinder lock.

The back plate 22, secured to the door by suitable mounting screws, carries the latchbolt subassembly 21 (FIGS. 2A, 4B and 6). Also mounted on the back plate 22 (as best seen in FIG. 4A) is a control member in the form of a slider plate 36 carried on outwardly projecting pins 37 received in slots 38, allowing limited horizontal sliding movement. Attached to the back plate and projecting forwardly therefrom are a pair of actuating pins 39 by means of which the plate is slide left and right by the action of the mode control mechansim 33. The lower edge of the slider plate is formed with a pair of vertical slots 40 and a central depending acutating finger 41 which enters a slot 42 in the upper surface of the housing of the subassembly 21 (FIGS. 6 and 7) to engage a finger 24*a* (FIG. 2A) on the dead latch pivot arm 24 so that movement of the slider plate 35 can release the dead latch. A cam 43*a* connected to the outside lock cylinder 35 engages a clamp 43 (FIG. 6) on the slider plate whereby key action slides the plate.

The inside lock 34 has its cylinder connected to three integrated control cams 44, 45 and 46, respectively, and the surface actions of which are described at a later point. The mode control mechanism 33 also includes (1) an alarm conditioning and time delay switch 47 having a cam-actuated tongue 47*a;* (2) an alarm pawl 48 carried on a pivot shaft 48*a* and normally biased by a spring 48*c* in a counterclockwise direction as viewed in FIGS. 7 and 8 (the pivot shaft also carries a color flag 48*b* which shows either of two colors in an aperture 48*d* in the face of the armored housing 14); and (3) an axially movable push button 49 projecting from the face of the armored housing 14 beside the lock cylinder 34 and below the aperture 48*d*. The push button is spring biased outwardly by a spring 50 and is formed with a tapered tip 49*a* which can enter one of the four vertical slots 40 and 40' in the slider plate 36. Also carried by the pushbutton control shaft 49 is a dogging pawl 51 which interacts with the surfaces of the cam 45. The detachable armored housing 14 and its internal componenets including the battery 30, the circuit 31, the alarm 32 and mode control mechanism 33, are adapted to be pivotally attached to the base plate 22 by separable, complementary hinge parts 52*a* and 52*b* (FIGS. 3 and 4B). It should be understood that the armored housing 14, as seen in FIG. 3, is shown rotated 180° with respect to the base plate 22 as shown in FIGS. 4A and 4B. To assemble the two parts, the armored housing 14 is pivotally connected at the hinge 52*a*–52*b* to the base plate 22 and swung upwardly into position where it is gripped by spring fingers 14*a* and 14*b* (FIGS. 4A and 4B) and locked by appropriate actuation of the inner lock cylinder 34.

The alarm circuit 31 includes, in addition to the switch 47, an alarm-energizing control switch 53 (FIGS. 2A and 3) actuated by a striker plate 54 under the control of the pivot arm assembly of the panic bar, as best seen in FIG. 2A. The control circuit (FIG. 5) includes a remote turn-off switch 55 and two time delay circuits R1, R2 and C1 and R1, C2 and R3.

OPERATION OF THE EXIT AND ENTRY CONTROL LOCK SYSTEM a. Controls

The controls are (1) the key-operated cylinder 34 on the inside of the door, (2) the push button 49, and (3) the alarm indicator 48*b* with its viewing aperture 48*c*, all on the front face of the housing 14 and 4) the key operated cylinder 35 on the outside of the door and connected to the device through the door.

b. CONTROL FUNCTION

The system includes four control functions as follows:

1. Disarming the alarm by use of a key from the inside to permit exiting;
2. Disengaging the dead latch 24 on the latchbolt 19 in the mechanism by use of a key from the outside of the door to permit entering;
3. Opening the armored housing 14 by use of a key from the inside for servicing; and
4. Pre-setting the device into any one of four possible modes by use of the key and button on the device. These four modes are as follows:

a. Authorized Passage (alarm indicator flag 48*b* shows red, button is "out"). This requires the use of a key for entering and leaving. An alarm will sound if a key is not used when leaving.

b. Authorized Exit Only (alarm indicator flag shows red, button is "in"). This requires the use of a key leaving but entering is prevented even with the use of a key. An alarm will sound if a key is not used when leaving.

c. Free Passage (alarm indicator flag shows green, button is "in"). This permits entering and leaving without the use of a key.

d. Free Exit Only (alarm indicator flag shows green, button is "out"). This permits leaving without key but requires the use of a key to enter.

TO OPEN THE HOUSING (CONTROL FUNCTION 3)

All the parts shown in FIGS. 4B and 6 (in addition to certain non-moving parts not shown) are mounted directly to the back plate 22 on the door 11 and remain on the door when the housing is removed. All the parts shown in FIGS. 3 and 8 (in addition to certain non-moving parts not shown) are mounted directly to the housing 14 which can be hinged open and removed from the back plate assembly as one assembly.

A key in the inside lock cylinder 34 is required to rotate the control cams 45 and 46. When the back plate assembly and housing assembly are latched together, the key and associated control cam must be in a position so that the largest diameter surface B on control cam 45 is in a non-interference position with the extended end of the pivot pin 60 which protrudes from the latchbolt assembly 21. For purposes of describing opening and closing of the housing, this position is described as one-half turn (180°) of the key which can be identified by the feel of the pawl 48 in a detent or depression (not shown) in the cam surface 46. When the unit is closed and the control cam is returned to its normal position by the key, the largest diameter B of the control cam 46 is captured behind the pivot pin 60 preventing the unit from being opened without a key.

MECHANISM AND CONTROLS INTERFACE FOR DISENGAGING LATCHBOLT (CONTROL FUNCTION 2)

Figure 7:
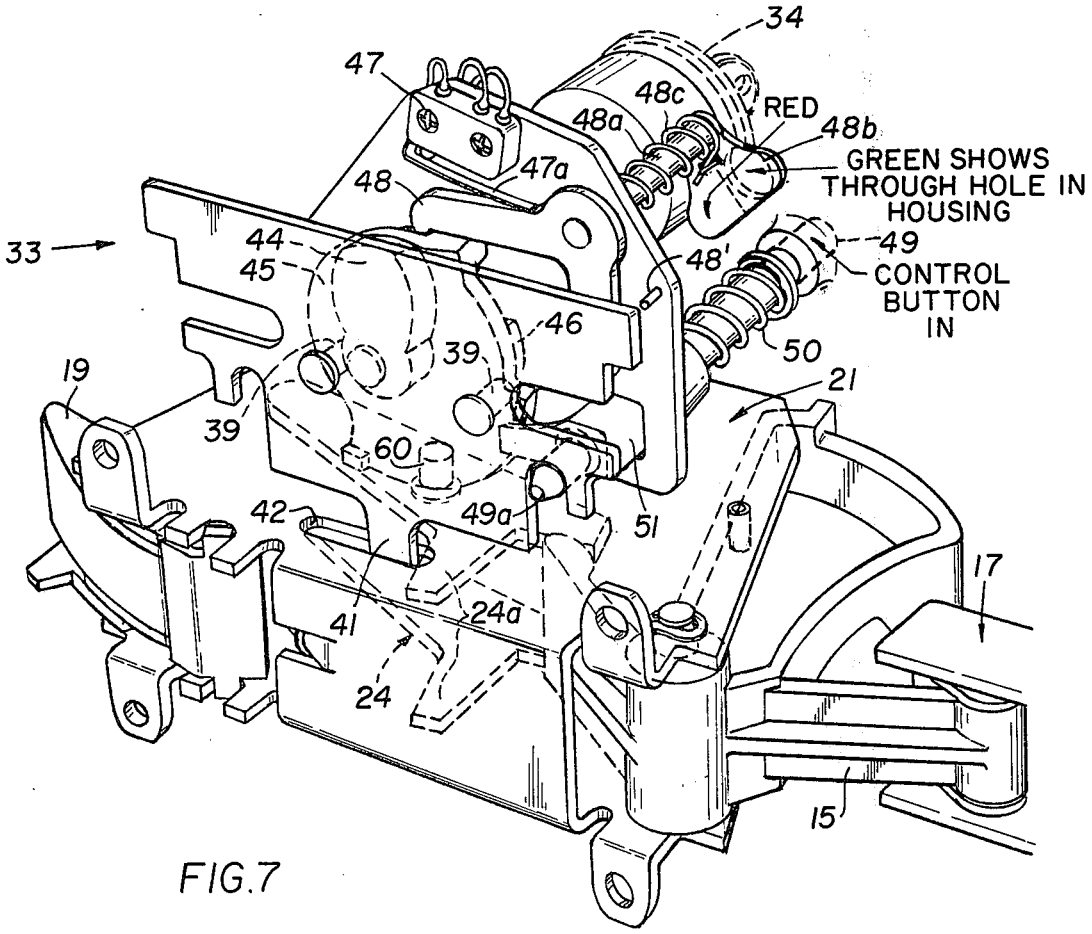
FIG. 7 is a view in perspective of the internal latchbolt mechanism and mode control mechanism linked thereto as seen from the outside of the door with the casing and other mechanism including the alarm and battery removed.

The latchbolt assembly 21 can be installed to the back plate 22 in one of two ways, depending on which side of the door the unit is mounted. FIG. 6 shows the assembly 21 as it would appear if the unit is mounted to the left side of a door but it would be inverted as shown in FIG. 7 if the unit were mounted on the right side of a door hinged on its left side.

The slot 42 is duplicated on both sides of the assembly to receive the slider plate 36 to engage the arm 24*A* on the dead latch pivot arm 24 to release the latchbolt for swinging movement into the housing (or out of the keeper) when the door is pushed open. The dead latch can be moved from its locking position by the panic bar pivot arm 15 when the panic bar 17 is pushed to open the door from the inside or by the sliding action of the slider plate 36 against the arm 24*A* of the dead latch pivot arm 24. This sliding action of the slider plate occurs in two situations: One is when a key is used to open the door from the outside. As shown in FIG. 6, the key in the outside cylinder lock 35 rotates the cam 43*a* against the clamp 43 which in turn moves the slider plate. The other situation occurs when an inside key is used to pre-set the mode of free passage which moves the slider plate and action of the control cam against the slider plate, as described below under the heading, "Pre-Setting Modes."

DESCRIPTION OF KEY CONTROL AND AUTHORIZED EXIT (CONTROL FUNCTION 1)

As described above, a key operates the control cams 45 and 46 directly. The alarm pawl 48 controls the travel of the control cams allowing 360° rotation and actuates the alarm switch 47 causing it to be "on" or "off" depending on the position of rotation of the control cam 46. FIG. 7 shows the alarm switch being held "off" by the alarm pawl. FIG. 8 shows the alarm switch in an "on" condition with the tip of the alarm pawl resting in a slot J in the control cam 46. A short clockwise rotation of the control cams 45 and 46 with a key will cause the alarm pawl to withdraw from its position in the slot and make contact with the switch, turning the alarm off. During authorized exit (Control Function 1), this is done by turning the key approximately one-fourth turn (90°) before pushing panic bar 17. To re-arm the alarm, the key is turned counterclockwise until the pawl is engaged (FIG. 8) by the surface F and driven against a stop pin 48'.

The alarm pawl 48 is secured to its shaft 48*a* with the alarm indicator flag which displays to the operator whether the alarm is in an "on" or "off" condition by revealing a red or green color through the aperture 48*c* in the housing.

DESCRIPTION OF CONTROL BUTTON FUNCTION

The control push button 49 is directly attached to the dogging pawl 51 as shown in FIG. 8. The primary function of the control button is to hold the slider plate 36 in one of two positions to be described under the heading "Pre-Setting Modes," but its secondary function is the interaction of the dogging pawl with the faces on the control cams 45 and 46 which prevents accidentally placing the unit in a mode that would not be properly identified by the position of the control button and the exposed color of the alarm indicator flag 48*b* on the front of the housing, also to be described in detail under the heading "Pre-Setting Modes."

PRE-SETTING THE MODES (CONTROL FUNCTION 4)

The controls for changing modes in accordance with the invention prevent accidental changes of modes when using the key for exiting or when opening the housing. The mode in which the unit has been set cannot be changed without depressing the control button.

1. TO CHANGE THE CONTROL FROM THE NORMAL MODE (AUTHORIZED PASSAGE, ILLUSTRATED IN FIG. 8) TO AUTHORIZE EXIT ONLY

A key is inserted in the inside lock cylinder 34 and rotated clockwise one-half turn (180°) to turn the control cams 44, 45 and 46. The hooked tip of the alarm pawl 48 will withdraw from its position in a slot J on the control cam 46 causing rotation of its shaft 48*a*, thereby changing the alarm indicator flag from "red" to "green", while the alarm pawl contacts the switch 47 turning the alarm off. The torsion spring 48*c* will cause the alarm pawl to have a frictional drag against the outer surface A of the control cam 46 while rotating and will come to rest in a slight recess or detent (not shown) indicating the 180° position to the operator by feel and by a partial display of red in the alarm indicator aperture 48*c* in the face of the housing. The surface B on the control cam 45 has a larger radius than surface C. This larger radius traps the dogging pawl from moving when an attempt is made to depress the control button, but in the new position (180°) of the control cam, the surface C offers no interference with the dogging pawl which can now be moved past the control cam by depressing the control button. It can be seen in FIG. 9A that the control cam 44 can rotate freely in its 180° rotation without contacting either of the pins 39 on the slider plate. The control button is now held in until the control cam is returned to its original position by rotating the key counterclockwise 180° and removing it. The dogging pawl will now be captured on the opposite side of the control cam with the control button depressed, the tip 49*a* of which is now positioned so as to prevent the slider plate from being able to move from its normal position and thereby preventing entrance with a key. The alarm pawl is returned to its original slot J in the control cam, releasing the switch 47 turning it back "on" and changing the alarm indicator flag back to "red." It is now impossible to change this mode without pushing the control button because with a quarter turn of the control cam by the key, the dogging pawl will contact a lug E on the control cam 45 preventing further rotation.

2. TO RESTORE THE CONTROL FROM AUTHORIZED EXIT ONLY TO AUTHORIZED PASSAGE

A key is inserted and rotated clockwise one-fourth turn (90°) until the tip of the dogging pawl comes in contact with the lug E on the rotating control cam. The control button 49 is then pushed so that the dogging pawl clears the lug E and the key can then be rotated further to the 180° position where it detents as previously described. The dogging pawl may now clear the control cam past surface C when the control button is released. The control cam is then rotated counterclockwise 180° with the key to its original position where the key is removed. The switch 47 will be actuated to "off" and back to "on" and the alarm indicator flag 48*b* will change to "green" and back to "red" during this operation, the same as going into the Authorized Exit mode.

3 & 4. TO CHANGE THE CONTROL FROM AUTHORIZED PASSAGE TO FREE PASSAGE AND FREE EXIT ONLY

A key is inserted and rotated clockwise, turning the control cam until the tip of the alarm pawl first contacts the switch 47, passes the detent position at the one-half revolution (180°) at which point the control cam will contact a pin 39 on the slider plate and begin to cam the slider plate laterally which in turn releases the dead latch arm 24 from the dead latching engagement with the latchbolt 19. When the control cams have been rotated three-fourths turn (270°) the slider plate will have been slid to the limit of its travel (see FIG. 9B) and the lug F on the control cam 45 comes to rest on the end of the tip of the dogging pawl preventing further rotation. The dogging pawl can now be moved to the other side of the control cam by pushing the control button and holding it, the tip 49*a* of which engages the slider plate preventing it from moving from its new position.

3. FOR FREE PASSAGE (SEE FIG. 7)

The control cam is now rotated an additional one-fourth turn (90° ) until the tip of the alarm pawl 48 comes in contact with the lug F on the control cam and stops the rotation, continuing to hold switch 47 "off." The dogging pawl is now dropped back by releasing the control button so that it rests beside the lug D on the control cam. The dogging pawl is captured behind the control cam 45 which keeps the control button in. It is now impossible to change this mode without pushing the control button because the lug D on the control cam prevents the control cam from rotating.

4. FOR FREE EXIT ONLY

If instead of the procedure of paragraph 3 above, the control cams 44, 45 and 46, which move as one, are rotated an additional one-eighth turn (45°), keeping the control button in so that the tip of the dogging pawl clears the lug F. The dogging pawl can now be retracted to its normal position by releasing the control button which releases the slider plate 36 restoring it to an unrestrained condition and allowing the dead latch pivot arm 24 to be returned by its own spring to its dead latching position in which the roller 25 engages the tail of the latchbolt in an over-centered position as defined by the stop 24. The control cam is then rotated a final one-eighth turn (45°) until the tip of the alarm pawl comes in contact with the lug F on the control cam, stopping its rotation but continuing to hold the switch 47 "off." The key is then removed. It is now impossible to change this mode without pushing the control button because with a one-fourth turn (90°) counterclockwise, the lug F on the control cam will contact the tip of the dogging pawl preventing further rotation.

5. TO CHANGE THE CONTROL FROM FREE PASSAGE TO AUTHORIZED PASSAGE

A key is inserted and the control button 49 is depressed which lifts the dogging pawl so that it can clear the lug D on the control cam. The control cam is then rotated by the key one-half turn (180°) counterclockwise to the detent during which time the finger on the dogging pawl clears the lugs D and F on the control cam and moves the control cam out of its path of contact with the pin 39 on the slider plate 36. The dogging pawl is then returned to its normal condition by releasing the control button which releases the slider plate allowing it to return to its original position which allows the dead latch pivot arm 24 to move to dead latching position behind the latchbolt. The control cam is rotated an additional one-half turn (180°) by the key until the alarm pawl tip disengages with the switch 47 turning the alarm back "on" as the alarm pawl returns into the slot J in the control cam which also changes the alarm indicator flag from "green" to "red". The key is then removed.

6. TO CHANGE THE CONTROL FROM FREE EXIT ONLY TO AUTHORIZED PASSAGE

A key is inserted and the control cam is rotated one-fourth turn (90°) counterclockwise until the lug F on the control cam stops against the tip of the dogging pawl. This rotation also causes the control cam to cam against a pin 39 on slider plate forcing it over to the other end of its travel. The dogging pawl is then moved to the other side of the control cam by depressing the control button 49. While holding the dogging pawl in, the control cam is turned in its counterclockwise direction with the key another one-quarter turn (180°position) to the detent during which rotation the tip of the dogging pawl clears the lug F on the control cam and moves the control cam out of its path of contact with the pin 39 on the slider plate. The dogging pawl is then returned to its normal condition by releasing the control button which releases the slider plate allowing it to return to its original position. The control cam is then rotated an additional one-half turn (180°) by the key until the alarm pawl disengages with the switch 47 turning the alarm back "on" as the alarm pawl returns into the slot in the control cam which also changes the alarm indicator flag from "green" to "red." The key is then removed.

For simlification, all the descriptions under the heading "Pre-Setting the Modes" are for the unit when it is mounted on the right hand side of the door. It will be understood that in order to accommodate the unit to both right hand and left hand opening doors there will be certain reversals of part positions both left and right and up and down which need not be specifically described herein for a complete understanding of the invention. FIGS. 9A, 9B and 9C, however, show the significant control cam and slide plate positions for right hand door installation and FIGS. 10A, 10B and 10C show the same left hand door installation.

In summary, the system includes a latchbolt 19 which can be secured in locking position by a releasable dead latch 24 which can be actuated by two independently operable dead latch release actuators, one of which constitutes the panic bar 17 and its pivot arm linkage 15. This portion of the system also includes a switch actuating link 54 which operates a primary alarm switch 53 to connect the battery 30 to the horns 32. The second dead latch release actuator is key actuated and takes the form of the slide plate 36 which is movable between active and inactive positions to release or to activate, respectively, the dead latch. Thus the key actuated control is in parallel with that of the panic bar.

The principal key actuated control is operated from the inside lock cylinder 34 and takes the form of a multiple cam assembly 44, 45 and 46 which performs multiple functions depending upon its positioning. As stated, it operates the slide plate 36 and thus can control the dead latch. Another portion of the multiple cam operates a switch 47 which is capable of opening the circuit to the horns 32 so that they cannot be sounded by means of the panic bar switch 53. Still other surfaces of the multiple cam operate in cooperation with the mode-controlling push button 49 whose function it is when pressed inward to lock (by means of its tip 49*a*) the slide plate 36 in either of its two positions, one of which is out of engagement with the dead latch linkage and the other of which holds the dead latch linkage in its inoperative or non-locking position. Lateral surfaces on the multiple cam lock the pushbutton 49 in its inner position (against its return spring pressure), causing its tip 49*a* to enter one of the slots 40 to lock the slide plate in its inactive, non-releasing position, or in one of the outer slots 40' to lock the slide plate in its dead latch release position.

The fourth function of the multiple cam is to lock the armored housing 14 on the base plate 22 by means of a cam face being rotated to a position behind the projecting shaft pin 60 of the latchbolt housing. Thus, a single key can be used to unlock the unit, to unlock the door (without triggering the alarm) and also to set any one of four modes of operation for the system in which (1) the latchbolt is locked and the alarm is armed, (2) the latchbolt is locked and the alarm is armed but the outside key control is disabled, (3) the latchbolt is locked and the alarm is unarmed, and (4) the latchbolt is unlocked and the alarm is unarmed for free passage in all directions.

A second key-actuated system can be included in the form of an outside lock cylinder 35 which is coupled directly to the dead latch release actuator or the slide plate 36, this being accomplished through a single cam 43*a* working against a shoulder clamp 43.

Figure 5:
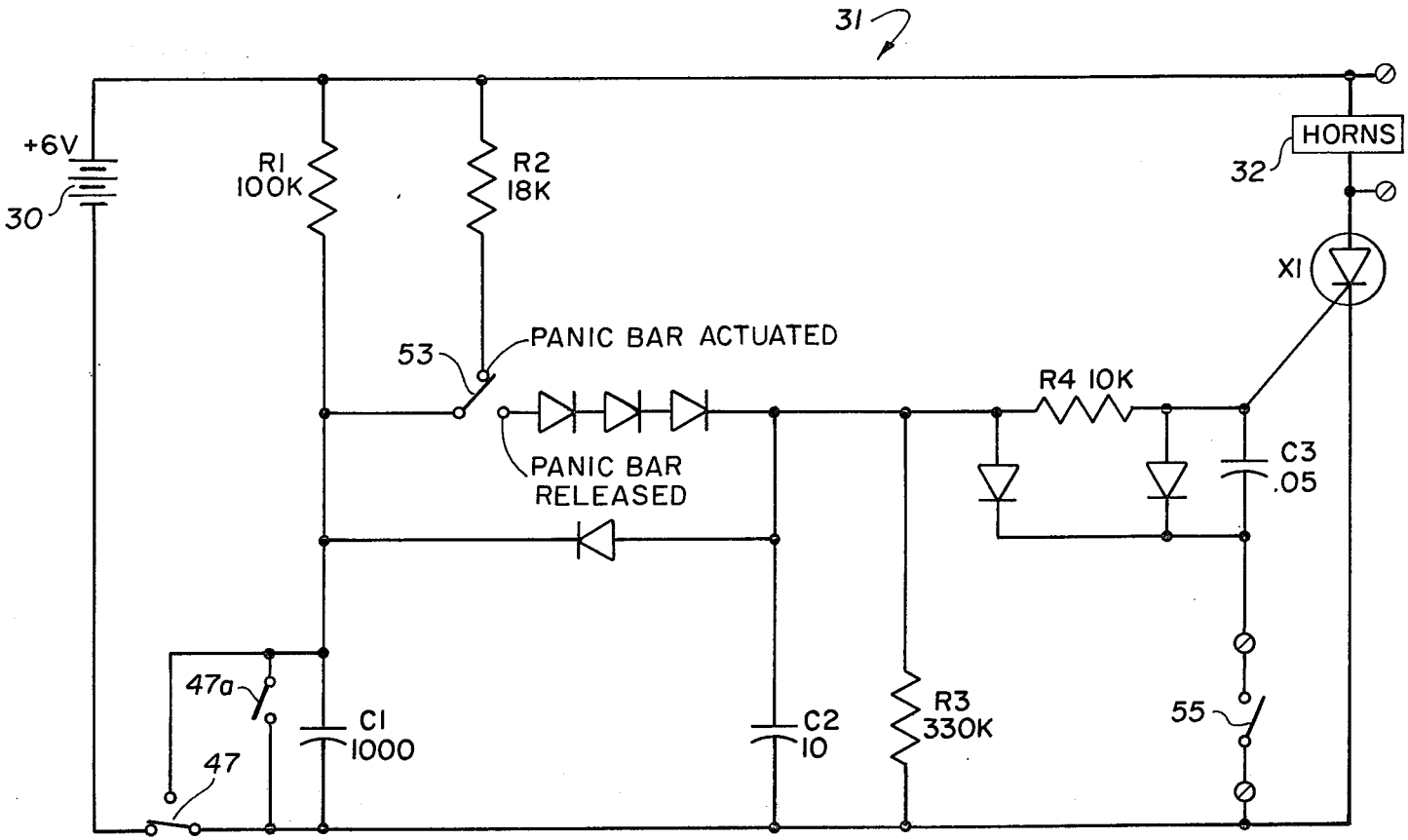
FIG. 5 is a circuit diagram of the alarm system.

The control circuit for the alarm as shown in FIG. 5, in addition to firing the alarm when the switch 53 is actuated by the panic bar, provides a three to six second alarm delay through the action of the time delay circuit R2-C1, which delays the firing of the SCR X-1. Thi allows an authorized user having an inside key approximately three seconds' time from turning the key (to start the timing cycle by discharging the condenser C1) to the instant the panic bar is pushed to actuate switch 53, which period should allow ample time for one-hand operation of both key and door. Once the panic bar is down, the system allows holding the panic bar down for as long as thirty seconds under the control of the timing circuit R1-C2. Once the panic bar has been released to return the switch 53 to its original position, it re-arms in whatever is left of the original three-second schedule of timing circuit R2-C1. Thus, fast re-arming occurs after the panic bar is released and decreases the possibility of a miscreant sneaking out behind an authorized user of the exit control by quickly pushing the panic bar.

While the invention has been described above having reference to a preferred embodiment thereof, it will be understood that it can take various other forms and arrangements without departing from the scope of the present invention. For example, remote reading indicators can be connected to the circuit to indicate authorized or unauthorized use remotely from the door. Also, if desired, the system can be arranged so that different keys are required for changing the mode and for gaining authorized exit. In one such arrangement, a key-operated switch 47*a* can be placed in parallel with the key-operated switch 47. Whereas the key used to actuate the switch 47 can be used as described above, both to change the mode of operation of the system and to gain authorized exit without triggering the alarm, the second key-operated switch 47*a* can only be used to set the timing circuit to allow time for authorized exit without tripping the alarm. By this means, a number of keys can be issued to those desiring to exit under authorization, whereas a limited number of keys not generally available can be used to change the mode. In accordance with the invention, the functions of changing mode and authorized exit can also be kept isolated one from the other by causing the second key, i.e. the key which actuates the supplemental switch 47*a*, to actuate a mechanical stop (not shown) which prevents rotation of the primary key, i.e. that which operates the switch 47 as well as changing the mode, from turning more than 90°. In this fashion, the primary key can only be used to gain authorized exit unless it is enabled by actuation of the second key to release the system for full rotation as required to change the mode, all as described above. The invention should not, therefore, be limited except as defined in the following claims:

I claim:

1. Exit and entry control lock apparatus for doors comprising, in combination:

a. a latchbolt for releasably holding the door in closed position;

b. dead latch means for securing the latchbolt against release;

c. first and second independently operable dead latch release actuators, said second release actuator comprising:

i. a control member movable between active and inactive positions, and ii. a mode control member movable between two positions to secure the control member selectively in either of its positions;

d. a panic bar connected to the first release actuator;

e. a key-actuated means connected to the second release actuator;

f. an alarm and energizing means therefor;

g. an alarm-energizing control switch connected to be actuated upon actuation of the panic bar; and h. alarm-disabling switch means coupled to said key-actuated means to disable the alarm-energizing means.

2. Exit and entry control lock means as set forth in claim 1, said key-actuated means including locking means to secure the mode control member in either of its two positions.

3. Exit and entry control lock means as set forth in claim 2, including a detachable armored housing for the apparatus, said key-actuated means including a locking member to secure the armored housing.

4. Exit and entry control lock means as set forth in claim 2, including:

a. second key-actuted means on the opposite side of the door from the first-recited actuated means; and b. means to couple the second key-actuated means to said control member.

5. Exit and entry control lock means as set forth in claim 1, including:

a. a key-operated alarm actuator;

b. an alarm-conditioning circuit connected to the actuator; and c. an indicator member movable with the actuator to indicate armed and disarmed modes of the alarm.

6. Exit and entry control lock means as set forth in claim 1, said mode control member comprising a manually movable stop member to hold the control member in either of its two positions.

7. Exit and entry control lock means as set forth in claim 6, said key-actuated means comprising a multiple cam assembly and a link between the cam assembly and the stop member to secure the latter in its holding engagement with the control member.

8. Exit and entry control lock means as set forth in claim 7, said multiple cam also including portions to engage, respectively, the control member and the alarm-energizing control switch.

9. Exit and entry control lock means as set forth in claim 1, including:

a. a base adapted to be attached to a door to carry the said apparatus;

b. a common subassembly housing for the said latchbolt, dead latch means and said release actuator connected to the panic bar, the latter being disposed on the opposite end of the housing from the latchbolt, said subassembly housing being mountable on the base plate with the latchbolt pointing either right or left to accommodate either right or left hand opening doors.

10. Exit and entry control lock means as set forth in claim 7, said control member comprising a slide plate having substantially identical and symmetrical right and left hand portions to accommodate either right or left hand door mounting.

11. Exit and entry control lock means as set forth in claim 10, including:

a. second key-actuated means on the opposite side of the door from the first recited key-actuated means;

b. second cam means connected to the second key-actuated means and coupled to the slide plate; and c. third cam means connected to the first-recited key-actuated means coupled to the slide plate.

* * * * *

UNITED STATES PATENT OFFICE
CERTIFICATE OF CORRECTION

Patent No. 4,006,471 Dated February 1, 1977

Inventor(s) MICHAEL PAPPAS

It is certified that error appears in the above-identified patent and that said Letters Patent are hereby corrected as shown below:

Column 6, line 56, before "EXIT", change "AUTHORIZE" to --AUTHORIZED--;

" 10, " 20, before "allows", change "Thi" to --This--;

" 11, " 37, change "actuted" to --actuated--;

" 11, " 38, after "first-recited" insert --key--;

" 12, " 20, after "base" insert --plate--.

Signed and Sealed this

Twelfth Day of April 1977

[SEAL]

*Attest:*

RUTH C. MASON
*Attesting Officer*

C. MARSHALL DANN
*Commissioner of Patents and Trademarks*